US006066383A

United States Patent [19]

Smith

[11] Patent Number: 6,066,383

[45] Date of Patent: May 23, 2000

[54] APPLIANCE PROTECTION DEVICE

[76] Inventor: Jesse Smith, P.O. Box 45252, Little Rock, Ark. 72214

[21] Appl. No.: 09/074,221

[22] Filed: May 7, 1998

[51] Int. Cl.[7] ..... E06B 1/68

[52] U.S. Cl. ..... 428/131; 428/156; 428/343; 428/900; 52/273; 52/287.1; 52/290; 312/296; 312/297; 312/352; 312/1

[58] Field of Search ..... 428/131, 156, 428/343, 900; 312/296, 297, 1, 352; 52/273, 287.1, 290

[56] References Cited

U.S. PATENT DOCUMENTS

| | | | |
|---|---|---|---|
| 2,000,243 | 5/1935 | Manske | 52/273 |
| 2,130,041 | 9/1938 | Slaughter | 52/273 |
| 2,300,084 | 10/1942 | Wright | 52/273 |
| 2,994,905 | 8/1961 | Franker, Jr. | 52/273 |
| 3,408,250 | 10/1968 | Finerock | 52/273 |
| 5,243,798 | 9/1993 | Elliott | 52/273 |
| 5,313,754 | 5/1994 | Jensen | 52/255 |
| 5,476,559 | 12/1995 | Chiro | 156/71 |
| 5,553,431 | 9/1996 | Pelosi, Jr. et al. | 52/287.1 |

*Primary Examiner*—William P. Watkins, III

[57] ABSTRACT

A new appliance protection device for improving cleanliness and sanitary conditions around and under appliances. The inventive device includes a plurality of strips adapted for coupling with lower ends of an appliance and abutting a floor surface. Each of the plurality of strips have a vertically disposed inner surface and an angularly disposed outer surface.

5 Claims, 2 Drawing Sheets

APPLIANCE PROTECTION DEVICE

BACKGROUND OF THE INVENTION

1. Field of the Invention

The present invention relates to protectors and more particularly pertains to a new appliance protection device for improving cleanliness and sanitary conditions around and under appliances.

2. Description of the Prior Art

The use of protectors is known in the prior art. More specifically, protectors heretofore devised and utilized are known to consist basically of familiar, expected and obvious structural configurations, notwithstanding the myriad of designs encompassed by the crowded prior art which have been developed for the fulfillment of countless objectives and requirements.

Known prior art protectors include U.S. Pat. No. 4,884,824 to Radke; U.S. Pat. No. 3,147,176 to Haslam; Patent No. WO 89/03650 to Kallman et al.; U.S. Pat. No. 2,595,833 to Flaherty; U.S. Pat. No. 4,650,002 to Pierce, Jr.; Patent No. EP 0 744 317 A1 to Walter; and U.S. Pat. No. 4,294,478 to Marquette.

While these devices fulfill their respective, particular objectives and requirements, the aforementioned patents do not disclose a new appliance protection device. The inventive device includes a plurality of strips adapted for coupling with lower ends of an appliance and abutting a floor surface. Each of the plurality of strips have a vertically disposed inner surface and an angularly disposed outer surface.

In these respects, the appliance protection device according to the present invention substantially departs from the conventional concepts and designs of the prior art, and in so doing provides an apparatus primarily developed for the purpose of improving cleanliness and sanitary conditions around and under appliances.

SUMMARY OF THE INVENTION

In view of the foregoing disadvantages inherent in the known types of protectors now present in the prior art, the present invention provides a new appliance protection device construction wherein the same can be utilized for improving cleanliness and sanitary conditions around and under appliances.

The general purpose of the present invention, which will be described subsequently in greater detail, is to provide a new appliance protection device apparatus and method which has many of the advantages of the protectors mentioned heretofore and many novel features that result in a new appliance protection device which is not anticipated, rendered obvious, suggested, or even implied by any of the prior art protectors, either alone or in any combination thereof.

To attain this, the present invention generally comprises a plurality of strips adapted for coupling with lower ends of an appliance and abutting a floor surface. Each of the plurality of strips have a vertically disposed inner surface and an angularly disposed outer surface. The plurality of strips each have a plurality of apertures therethrough in a spaced relationship along a length thereof. A plurality of magnetic strips are secured to the inner surfaces of the plurality of strips for engaging a metal surface of the appliance to facilitate securement of the plurality of strips to the appliance.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and. terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new appliance protection device apparatus and method which has many of the advantages of the protectors mentioned heretofore and many novel features that result in a new appliance protection device which is not anticipated, rendered obvious, suggested, or even implied by any of the prior art protectors, either alone or in any combination thereof.

It is another object of the present invention to provide a new appliance protection device which may be easily and efficiently manufactured and marketed.

It is a further object of the present invention to provide a new appliance protection device which is of a durable and reliable construction.

An even further object of the present invention is to provide a new appliance protection device which is susceptible of a low cost of manufacture with regard to both materials and labor, and which accordingly is then susceptible of low prices of sale to the consuming public, thereby making such appliance protection device economically available to the buying public.

Still yet another object of the present invention is to provide a new appliance protection device which provides in the apparatuses and methods of the prior art some of the advantages thereof, while simultaneously overcoming some of the disadvantages normally associated therewith.

Still another object of the present invention is to provide a new appliance protection device for improving cleanliness and sanitary conditions around and under appliances.

Yet another object of the present invention is to provide a new appliance protection device which includes a plurality of strips adapted for coupling with lower ends of an appliance and abutting a floor surface. Each of the plurality of strips have a vertically disposed inner surface and an angularly disposed outer surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
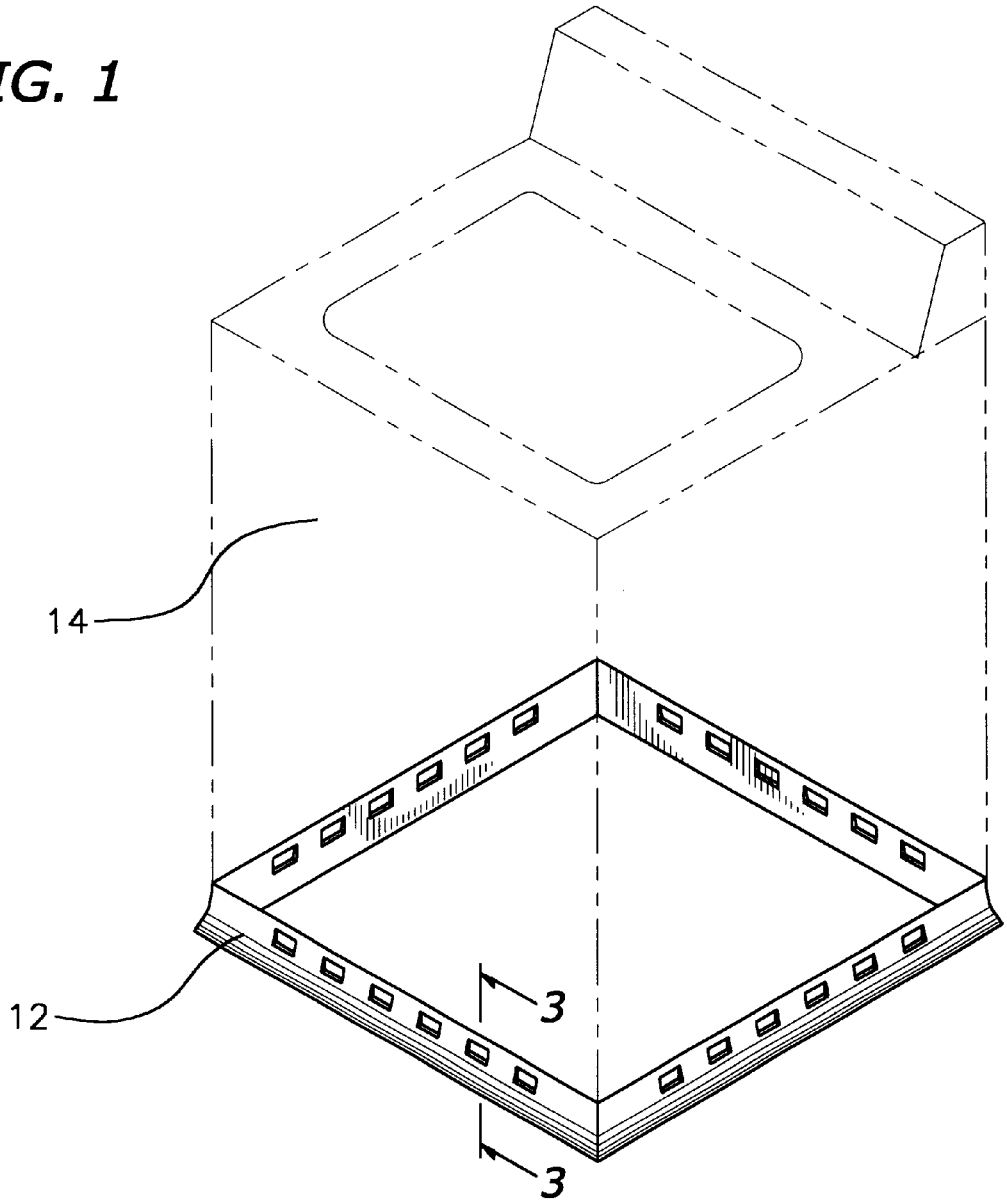
FIG. 1 is a perspective view of a new appliance protection device according to the present invention illustrated in place on an appliance.
Figure 2:
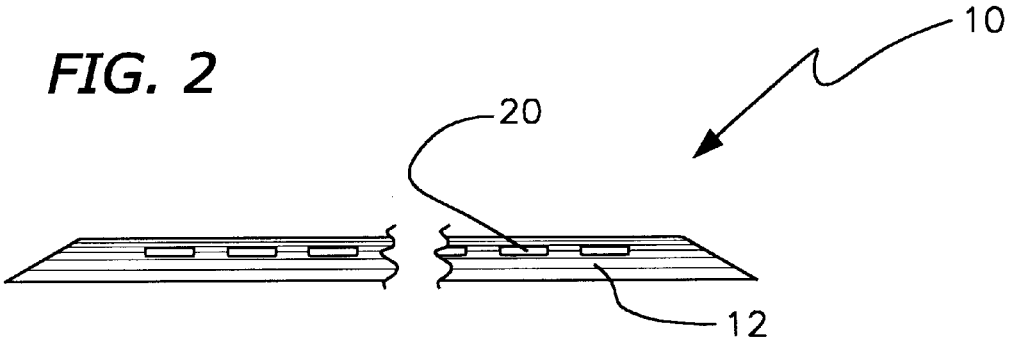
FIG. 2 is a front view of the present invention.
Figure 3:
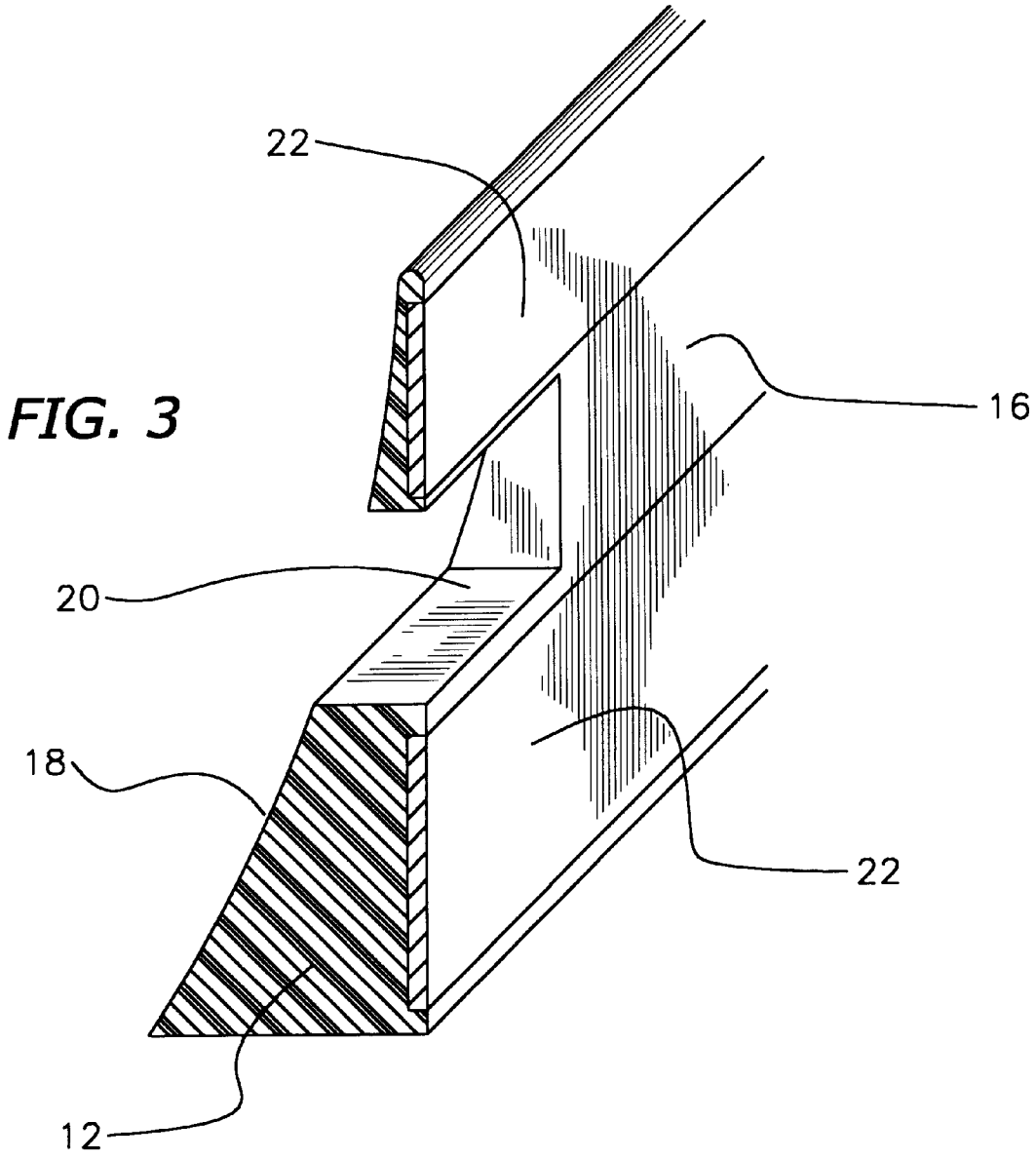
FIG. 3 is a cross-sectional view of the present invention as taken along line 3—3 of FIG. 1.
Figure 4:
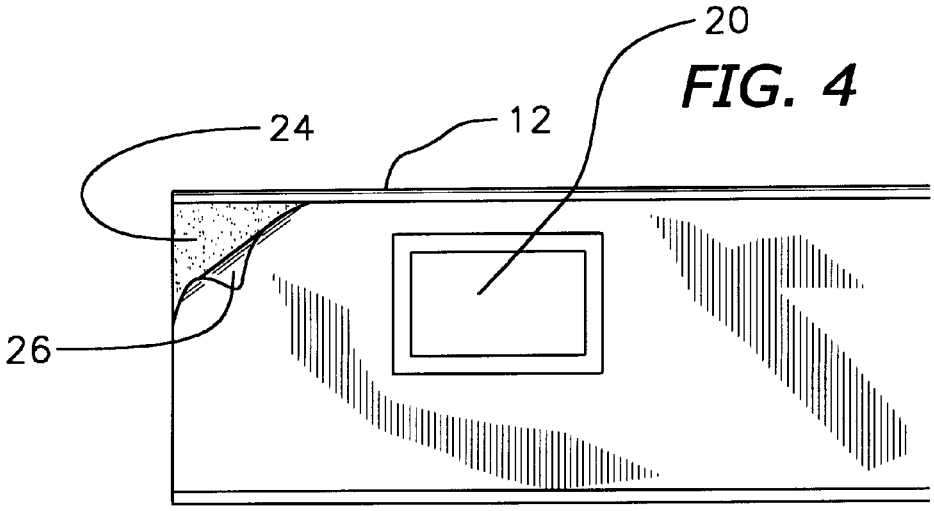
FIG. 4 is a perspective view of an alternate embodiment using adhesive strips as the securement means for the present invention.

With reference now to the drawings, and in particular to FIGS. 1 through 3 thereof, a new appliance protection device embodying the principles and concepts of the present invention and generally designated by the reference numeral 10 will be described.

As best illustrated in FIGS. 1 through 4, the appliance protection device 10 comprises a plurality of strips 12 adapted for coupling with lower ends of an appliance 14 and abutting a floor surface. Each of the plurality of strips 12 have a vertically disposed inner surface 16 and an angularly disposed outer surface 18. The plurality of strips 12 each have a plurality of apertures 20 therethrough in a spaced relationship along a length thereof. The apertures 20 are included to provide ventilation. The plurality of apertures 20 could optionally be provided with fillers that could be removed. The fillers could be left in place on appliances not requiring ventilation.

A plurality of magnetic strips 22 are secured to the inner surfaces 16 of the plurality of strips 12 for engaging a metal surface of the appliance 14 to facilitate securement of the plurality of strips 12 to the appliance 14.

In an alternate embodiment, the magnetic strips 22 are replaced by adhesive strips 24. The adhesive strips 24 are provided with a removable backing 26 to protect the adhesive prior to use.

In use, the present invention would prevent dust, dirt, and other debris from accumulating underneath an appliance. The present invention would eliminate efforts for straining to clean underneath an appliance or to move a heavy appliance out of the way.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A appliance protection system for improving cleanliness and sanitary conditions around and under an appliance comprising, in combination:

an appliance having a top, a bottom, and a perimeter side wall extending between the top and bottom, the perimeter side wall having a lower portion adjacent the bottom, the lower portion having an exterior surface;

a plurality of strips coupled to the exterior surface of the lower portion of the appliance for abutting against a floor surface for blocking movement of matter along the floor surface to a position below the bottom of the appliance, each of the plurality of strips having a vertically disposed inner surface and an angularly disposed outer surface extending between a top edge and a bottom surface for resting against a floor surface, the plurality of strips each having a plurality of apertures therethrough for permitting heated air to escape from below the appliance, the plurality of apertures being positioned in a spaced relationship along a length thereof, the plurality of apertures being spaced from the bottom surface of the strip toward the top edge of the strip to resist movement of matter on the floor surface through the apertures;

a plurality of magnetic strips secured to the inner surfaces of the plurality of strips for engaging a metal surface of the appliance to facilitate securement of the plurality of strips to the appliance.

2. A appliance protection device for improving cleanliness and sanitary conditions around and under an appliance comprising:

a plurality of strips adapted for coupling with lower ends of an appliance and abutting a floor surface, each of the plurality of strips having a vertically disposed inner surface and an angularly disposed outer surface; and a plurality of strips adapted for coupling with an exterior surface of a lower portion of the appliance for abutting against the floor surface for blocking movement of matter along the floor surface to a position below a bottom of the appliance, each of the plurality of strips having a vertically disposed inner surface and an angularly disposed out er surface extending between a top edge and a bottom surface for resting against the floor surface, the plurality of strips each having a plurality of apertures therethrough for permitting heated air to escape from below the appliance, the plurality of apertures being positioned in a spaced relationship along a length thereof, the plurality of apertures being spaced from the bottom surface of the strip toward the top edge of the strip to resist movement of matter on the floor surface through the apertures.

3. The appliance protection device as set forth in claim 2 and further including securement means disposed on the inner surface of the plurality of strips to facilitate securement of the strips to the appliance.

4. The appliance protection device as set forth in claim 3 wherein the securement means are magnetic strips embedded within the inner surfaces of the plurality of strips.

5. The appliance protection device as set forth in claim 3 wherein the securement means are adhesive strips.

* * * * *